United States Patent [19]

Leone

[11] Patent Number: 5,030,687

[45] Date of Patent: Jul. 9, 1991

[54] DETERGENT-DISPERSANT ADDITIVES BASED ON SALTS OF ALKALINE-EARTH AND ALKALI METALS FOR LUBRICATING OILS

[75] Inventor: Savino Leone, Tassin Dela Demi-Lune, France

[73] Assignee: Orogil, France

[21] Appl. No.: 247,004

[22] Filed: Sep. 20, 1988

[30] Foreign Application Priority Data

Dec. 23, 1987 [FR] France ..... 87 18013

[51] Int. Cl.[5] ..... C10M 135/06

[52] U.S. Cl. ..... 252/40; 252/40.5

[58] Field of Search ..... 252/38, 41, 39, 40, 252/40.5

[56] References Cited

U.S. PATENT DOCUMENTS

| | | | |
|---|---|---|---|
| 3,036,971 | 5/1962 | Otto | 252/42.7 |
| 3,372,116 | 3/1968 | Meinhardt | 252/36 |
| 3,410,798 | 11/1968 | Cohen | 252/37.2 |
| 3,437,595 | 4/1969 | Coupland | 252/47.2 |
| 3,493,516 | 2/1970 | Allphin | 252/33.3 |
| 3,595,791 | 7/1971 | Cohen | 252/33.6 |
| 4,751,010 | 6/1988 | Leone | 252/33 |

FOREIGN PATENT DOCUMENTS

| | | |
|---|---|---|
| 0013731 | 3/1987 | France . |
| 127396 | 7/1985 | Japan . |

*Primary Examiner*—Jacqueline V. Howard

[57] ABSTRACT

Alkylsalicylate-containing detergent-dispersant additives for lubricating oils are obtained by (a) neutralizing an alkylphenol by means of an alkali metal hydroxide; (b) carboxylation of the product with carbon dioxide for maximum conversion of the initial alkali metal alkylphenate into alkali metal alkylsalicylate; (c) sulfurization-superalkalinization of the product in the presence of an alkaline earth base followed by carbonation of the product with carbon dioxide.

8 Claims, No Drawings

DETERGENT-DISPERSANT ADDITIVES BASED ON SALTS OF ALKALINE-EARTH AND ALKALI METALS FOR LUBRICATING OILS

BACKGROUND OF THE INVENTION

The object of the present invention is new detergent-dispersant additives based on sulfurized and superalkalinized alkylphenates of alkaline-earth metals and alkylsalicylates of alkali metals for lubricating oils. The Applicant has described related additives in his French patent application 85/13731 published as U.S. Pat. No. 2,587,353 on Mar. 20, 1987.

It is known (U.S. Pat. No. 3,410,798 and U.S. Pat. No. 3,595,791) how to prepare detergent additives by carboxylation of a potassium alkylphenate, exchange with calcium chloride, then sulfurization of the mixture of alkylphenate and alkylsalicylate of calcium with sulfur in the presence of lime, a carboxylic acid, an alkylene glycol or alkyl ether of alkylene glycol.

The product thus obtained consists mainly of a mixture of sulfurized calcium alkylphenate and partially sulfurized calcium alkylsalicylate. The Applicant has noted that if salts of alkali metals are present in this type of product, its performance is improved.

These products that are the object of the invention are characterized in that they are obtained by carrying out the following stages:

a. In a first stage the neutralization of an alkylphenol carrying one or more $C_8$–$C_{30}$, preferably $C_{12}$–$C_{30}$, alkyl substituents by means of an alkali metal hydroxide optionally in the presence of a azeotropic solvent forming an azeotrope with the reaction water selected among the aromatic or aliphatic hydrocarbons with a boiling point above 70° C., said neutralization operation being carried out at a temperature at least equal to that of the formation of the azeotrope or at a temperature greater than 200° C. in the absence of an azeotropic solvent, the quantities of reagents used corresponding to the molar ratio:

Alkali metal hydroxide/alkylphenol ranging from 0.1 to 1 and preferably from 0.1 to 0.5;

Elimination of the water and, optionally, any azeotropic solvent to form a first product;

b. In a second stage, the carboxylation of said first product to convert the alkali metal alkylphenate formed in said first product into an alkali metal alkylsalicylate by means of carbon dioxide at a temperature from 100° to 185° C. (preferably 140°–185° C.) under a pressure which can range from atmospheric pressure to 15 bars (preferably on the order of 5 bars) for at least 1 hour in the presence of a dilution oil or an aromatic or aliphatic hydrocarbon with a boiling point higher than 70° C., the quantity of $CO_2$ corresponding to that necessary to obtain a maximum conversion of the initial alkylphenol into alkali metal alkylsalicylate, to form a second product;

c. In a third stage, the sulfurization-superalkalinization of a mixture of said second product formed by adding elemental sulfur in the presence of an alkaline-earth base, an alkylene glycol and an azeotropic solvent chosen among the aromatic hydrocarbons, aliphatic hydrocarbons and monoalcohols with a boiling point greater than 120° C. and preferably greater than 150° C., at a temperature on the order of 140° to 240° C., the quantities of reagents used corresponding to the following molar ratios:

Sulfur/initial alkylphenol ranging from 0.7 to 1.5, preferably from 0.7 to 1.3,

Alkaline-earth base/initial alkylphenol from 0.5 to 2, preferably on the order of 0.8 to 1.7, Alkaline-earth base/alkylene glycol ranging from 1.2 to 1.4, followed by carbonation of the said mixture with carbon dioxide at a temperature of 100°–185° C. and under a pressure close to atmospheric pressure, the quantity of $CO_2$ used lying between that which can be completely absorbed by the reaction medium and an excess of 30% of this quantity, d. Elimination of the alkylene glycol and the azeotropic solvent after addition of dilution oil, e. Filtration to eliminate the sediments.

Among the alkali metal hydroxides that can be used in the neutralization stage, one may cite soda, potash, lithium hydroxide.

Among the azeotropic aromatic or aliphatic solvents, one may cite xylene, toluene, cyclohexane.

Among the monoalcohols with a boiling point greater than 120° C. one, may cite 2-ethylhexanol, the oxoalcohols, decyl alcohol, tridecyl alcohol, 2-butoxyethanol, 2-butoxypropanol, methylether of propylene glycol.

Among the alkylene glycols, one may cite: ethylene glycol, diethylene glycol.

Among the alkaline earth bases that can be used, one may cite the oxides or hydroxides of calcium, barium or strontium and especially calcium.

Among the dilution oils that can be used, one may cite preferably the paraffin oils such as the 100 Neutral oil; the naphthenic or mixed oils may also be suitable.

The first stage, that is, the neutralization stage, is advantageously carried out at a pressure close to atmospheric pressure.

When this neutralization process is carried out without an azeotropic solvent, it is generally carried out at a temperature on the order of 250° C.; when 2-ethylhexanol is used as an azeotropic solvent, a temperature on the order of 160°–170° C. is preferred; when the azeotropic solvent is cyclohexane, a temperature of 70°–80° C. is quite suitable.

The quantity of any azeotropic solvent used in this stage corresponds to that necessary to obtain a fluid medium, that is, of a viscosity below approximately $30\times10^{-6}$ m²/s under the reaction conditions.

The second stage, the carboxylation stage, can be carried out in the presence or in the absence of an azeotropic solvent possibly used in the neutralization stage.

The quantity of $CO_2$ to be introduced corresponds to that necessary to obtain a maximum conversion of the initial alkylphenol into alkali metal alkylsalicylate. This maximum conversion is a function of the alkali metal/alkylphenol molar ratio; when this ratio is 1, the maximum conversion is on the order of 85%; when the ratio is 0.5, it is approximately 45%.

This carboxylation operation generally lasts from 1 to 6 hours.

If the medium is viscous (viscosity greater than $200\times10^{-6}$ m²/s at 100° C.), which is the case especially when the alkaline hydroxide used is lithium hydroxide, an azeotropic solvent of the type used in the sulfurization-superalkalinization stage can be added at the end of the carboxylation.

The third stage, the sulfurization-superalkalinization stage, is preferably carried out at a temperature on the order of 140° to 160° C. for approximately 3–6 hours.

This operation may possibly be carried out in the presence of an additional quantity of alkylphenol when the conversion of the alkylphenol into alkali metal alkylsalicylate is high (at least 40%) so as to bring this conversion to a value on the order of 15 to less than 40%, generally in the order of 20 to 30%.

The carbonation itself is advantageously carried out at a temperature of 145°-180° C. under a pressure of approximately $930\times10^2$ to $1010\times10^2$ Pa.

According to one embodiment, the sulfurization-superalkalinization operation can be carried out by sulfurization of the product obtained by carboxylation, by means of elemental sulfur possibly in the presence of an alkali metal hydroxide, according to a quantity corresponding to an initial alkali metal hydroxide/alkylphenol molar ratio of 1/50 to 1/30 (especially when all the alkali metal alkylphenate has been converted into alkali metal alkylsalicylate) at a temperature on the order of 140° to 200° C., preferably on the order of 160° to 175° C., the sulfur/initial alkylphenol molar ratio ranging from 0.7 to 1.5, preferably from 0.7 to 1.3; this operation generally lasts from 2 to 6 hours;

the addition at a temperature of 50° to 80° C. of an alkaline earth base, an alkylene glycol and an azeotropic solvent selected among the aromatic hydrocarbons, the aliphatic hydrocarbons, and the monoalcohols with a boiling point above 120° C., and preferably above 150° C., the quantities of reagents corresponding to the following molar ratios:

alkaline earth base/initial alkylphenol of 0.5 to 2, preferably on the order of 0.8 to 1.7;

alkaline earth base/alkylene glycol on the order of 1.2 to 1.4;

then carbonation as indicated above.

After carbonation, dilution oil is introduced in a quantity such that the quantity of oil contained in the final product represents from 25 to 65 wt % of said product and preferably from 30 to 50 wt % of said product.

The additives that are the object of the invention exhibit high basicity; the TBN (total base number) of the additives based on calcium salts, for example, easily reaches 250 to 300 or more.

The quantity of additive to be used to improve the detergent-dispersant properties of lubricating oils is a function of the future use of said oils.

Thus for an oil for gasoline motors, the quantity of additive to be added generally lies between 1 and 3 wt %; for an oil for a diesel motor, it generally lies between 1.5 and 5 wt %; for an oil for a marine motor, it generally lies between 10 and 30%.

The lubricating oils that can thus be improved can be selected among very varied lubricating oils, such as lubricating oils with a naphthene base, with a paraffin base and with a mixed base, from other hydrocarbon lubricants, for example, lubricating oils derived from oil products, and synthetic oils, for example, alkaline polymers, polymers of the alkylene oxide type and their derivatives, including polymers of alkylene oxide prepared by polymerizing alkylene oxide in the presence of water or alcohols, for example, ethyl alcohol, the esters of dicarboxylic acids, liquid esters of acids of phosphorus, alkylbenzenes and dialkylbenzenes, polyphenyls, alkyl biphenyl ethers, polymers of silicon.

Additional additives can also be present in said lubricating oils besides detergent-dispersant additives obtained according to the process of the invention; one may cite, for example, antioxidant and anticorrosion additives and ashless dispersant additives.

The following examples are given as an indication and cannot be considered as a limit on the scope and the spirit of the invention.

EXAMPLES

Example 1

Neutralization

To a mixture consisting of 2619 g (10 moles) of dodecylphenol (DDP) and 1275 g of xylene, one adds 216.3 g of monohydrated lithium hydroxide. The medium is heated, the distillation of the water takes place at 105° C. after 40 minutes of heating. After 2 hours and 40 minutes the temperature of the medium then reaches 155° C., and one distills 89 g of water. The reaction is allowed to run for 4 hours; the quantity of water decanted represents 181.5 g, and the quantity of distilled xylene is 291 g.

Then one adds 1000 g of 100N oil and heats to 180° C.; in order to distill the xylene, one leaves the reaction medium for 1 hour gradually lowering the pressure to 2666 Pa. The quantity of xylene distilled represents 773 g and one recovers 3640 g of product.

Carboxylation

One charges 1373 g of product.

The medium is cooled to 140° C. and the reactor is placed under a $CO_2$ pressure (5 bars). The carboxylation reaction is carried out for 1 hour, and then 380 g of 2-ethylhexanol is added. The product is homogenized for 30 minutes before being cooled. A fluid product is recovered whose composition is as follows:

| | Wt | Moles |
|---|---|---|
| DDP | 482 | 1.84 |
| DDP Li | 292 | 1.09 |
| Salicylate Li | 252 | 0.808 |
| $Li_2CO_3$ | 13.4 | 0.18 |
| 2-Ethylhexanol | 380 | |
| 100 N Oil | 374.1 | |
| Wt. % $CO_2$ = 0.5 | | |

The conversion of the initial alkylphenol into alkylsalicylate is greater than 20%.

Sulfurization-Superalkalinization

To a mixture of 1756 g of the above product one adds at 70° C. a mixture of 389 g of lime and 99 g of sulfur. When after 45 minutes the temperature reaches 90° C., one adds 125 g of glycol. After 1 hour, when the temperature reaches 140° C., the distillation as well as the release of $H_2S$ start.

After 1 hour 45 min. the temperature reaches 155° C., and a second charge of glycol (125 g) is added. The reaction medium is kept at this temperature for 45 minutes, and 330 g 2-ethylhexanol is added.

After 30 minutes the temperature reaches 165° C., and flushing with nitrogen is carried out; the reaction mixture is maintained under these conditions for 1 hour.

Then the carbonation is started [and run] for 65 minutes until 144 g of $CO_2$ has been absorbed.

The mixture is heated to 185° C., a temperature at which 405 g of 100N oil is added.

Final distillation conditions: (190° C./5332 Pa).

The crude product obtained contains a proportion of sediment of 0.8 vol %.

After filtration (rate of filtration = 135 kg/h/m$^2$), the product obtained exhibits the following characteristics:

% Li = 0.6

% Ca = 8.1

Viscosity: $120 \times 10^{-6}$ m$^2$/s at 100° C.

% S = 2.65

TBN: 281

Example 2

Neutralization

A mixture of 2630 g (10 moles) of DDP and 1298 g of xylene is homogenized at ambient temperature for 30 minutes.

The mixture is heated gradually; at 75° C. one starts to introduce an aqueous 50% potash solution (653 g of solution is introduced during the entire neutralization operation).

The water/xylene azeotrope starts to distill after 30 minutes. The temperature reaches 150° C. at the end of 1 hour 30 minutes, and this temperature is maintained for 1 hour until the end of the addition of the potash solution.

This reaction medium is brought up to 160° C. in 1 hour and maintained at this temperature for 3 hours.

One thousand grams of 100N oil is added; then the xylene is distilled for 2 hours 30 minutes at 180° C. under a vacuum of 11997 Pa.

Carboxylation

The entire product is carboxylated under a $CO_2$ pressure (5 bars) for 5 hours at 180° C.

The fluid product obtained exhibits the following characteristics:

Conversion to alkylsalicylate = 40% wt. % $CO_2$ = 0.3

Sulfurization-Superalkalinization

To 994 g of the above product one adds 323 g of DDP and 400 g of 2-ethylhexanol.

The mixture is homogenized to 70° C., a temperature at which 365 g of lime and 91 g of elemental sulfur are added. To the solution brought to 85° C. one adds 125 g of glycol. The distillation starts 30 minutes after the addition (150° C.).

Two hours after the start of the distillation, the temperature reaches 170° C. After 20 minutes at this temperature, one adds a second charge of glycol (125 g), and the reaction mixture is left for 1 hour at this temperature, at the end of which time one adds 300 g 2-ethylhexanol. The temperature remains at 165° C., and the medium is carbonated for 70 minutes. The reaction solvents, glycol and 2-ethylhexanol, are distilled while one adds 528 g of 100N oil. Final distillation conditions (185° C./2666 Pa). The crude product contains a proportion of sediments of 0.02 vol %.

The characteristics of the filtered product are as follows:

% Ca = 7.26

% S = 2.21

% K = 1.9

TBN = 242

Viscosity = $10^{-6}$ m$^2$/s at 100° C.

Example 3

Neutralization

A mixture of 2620 g of DDP (10 moles) and 1301 g of xylene is homogenized at ambient temperature for 30 minutes.

The mixture is heated gradually; at 90° C. one starts to introduce a 50% aqueous soda solution (510 g of soda is introduced during the entire neutralization operation).

After 30 minutes the temperature reaches 115° C., and the distillation of the water/xylene azeotrope starts.

At the end of 2 hours, the temperature reaches 135° C., and the addition of soda starts.

At the end of 6 hours after the start of the addition of soda the temperature reaches 150° C., and 1000 g of 100N oil is added.

The xylene is distilled for 3 hours at 180° C. under 10664 Pa.

The reaction mixture is cooled to 140° C.

Carboxylation

The entire product is carboxylated under a $CO_2$ pressure (5 bars) for 3 hours at 180° C.

The fluid product obtained exhibits the following characteristics:

Conversion to alkylsalicylate = 41.3% wt. % $CO_2$ = 0.28%

Sulfurization-Superalkalinization

Into the reactor one charges 867 g of the above product, 387 g of dodecyl phenol, and 400 g of 2-ethylhexanol.

At 70° C. one adds 386 g of lime and 98 g of sulfur.

At 90° C. one adds 125 g of glycol. The distillation of the water/2-ethylhexanol azeotrope starts 20 minutes after the addition and at 140° C. After having reached 160° C., one leaves the reaction mixture for 2 hours at this temperature level; then one adds 405 g of 100N oil and then 125 g of glycol. After 20 minutes, the temperature reaches 155° C.; one then adds 300 g 2-ethylhexanol and one heats to 165° C. over 30 minutes. The reaction medium is kept at this temperature for 40 minutes before the carbonation starts, which lasts 60 minutes.

The solvents are distilled at 180° C. under 2666 Pa. The medium is heated to 185° C., and 405 g of 100 N oil is added. The crude product contains 0.7 vol % of sediments.

The characteristics of the filtered product are as follows:

% Ca = 9.1

% Na = 1.1

% S = 2.9

% Viscosity = $140 \times 10^{-6}$ m$^2$/s at 100° C.

TBN = 275

What is claimed is:

1. Alkylsalicylate-containing detergent-dispersant additives for lubricating oils produced by the process comprising the following stages:

a. in a first stage, neutralizing an alkylphenol, said alkylphenol having one or more $C_8$–$C_{30}$ alkyl substituents, by means of an alkali metal hydroxide, with the formation of water, in the presense of an azeotropic solvent forming an azeotrope with said water, selected from the group consisting of the aromatic or aliphatic hydrocarbons with a boiling point above 70° C., said neutralization being carried out at a temperature at least equal to that of the formation of the azeotrope, the reaction quantities used corresponding to the molar ratio:
alkali metal hydroxide/alkylphenol ranging from 0.1 to 1; and
eliminating water and any azeotropic solvent to form a first product comprising alkali metal alkylphenate;

b. in a second stage, carboxylating said first product to convert the alkali metal alkylphenate formed in said first product into alkali metal alkylsalicylate by means of carbon dioxide at a temperature of 100° to 185° C. under a pressure from atmospheric pressure to 15 bars for at least one hour in the presence of a dilution oil or an aromatic or aliphatic hydrocarbon with a boiling point greater than 70° C., the quantity of $CO_2$ corresponding to that necessary to obtain a maximum conversion of the alkali metal alkylphenate into alkali metal alkylsalicylate, to form a second product;

c. in a third stage, sulfurizing-superalkylinizing said second product by adding elemental sulfur in the presence of an alkaline earth base, an alkylene glycol and an azeotropic solvent, said azeotropic solvent selected from the group consisting of (a) the aromatic hydrocarbons, (b) the aliphatic hydrocarbons, and (c) the monoalcohols with a boiling point greater than 120° C., at a temperature in the range of about 140° to 230° C., the quantities of reagents used corresponding to the following molar ratios:
sulfur/alkylphenol ranging from 0.7 to 1.5,
alkaline earth base/alkylphenol from 0.5 to 2,
alkaline earth base/alkylene glycol ranging from 1.2 to 1.4, and
followed by carboxylating said second product with a quantity of carbon dioxide at a temperature of 100°–185° C. and under about atmospheric pressure, said quantity of $CO_2$ being in the range between that amount of $CO_2$ which can be completely absorbed by the reaction medium and an excess of 30% of said amount;

d. eliminating the alkylene glycol and the azeotropic solvent after addition of dilution oil;

e. filtering; and f. collecting a final product.

2. Additives according to claim 1 wherein the quantities of reagents used in the neutralization correspond to the following molar ratio:
alkali metal hydroxide/alkylphenol ranging from 0.1 to 0.5.

3. Additives according to claims 1 and 2 wherein the alkali metal hydroxide is soda, potash or lithium hydroxide.

4. Additives according to any one of the above claims, wherein the azeotropic solvent is 2-ethyl-hexanol, cyclohexane or xylene.

5. Additives according to any one of the above claims, wherein the alkaline earth base is calcium hydroxide or calcium oxide.

6. Additives according to claim 1, 2, 3, 4, or 5, wherein the third stage is carried out by:
sulfurizing said second product by means of elemental sulfur in the presence of an alkali metal hydroxide, with a quantity corresponding to an alkali metal hydroxide/alkylphenol molar ratio of 1/50 to 1/30 at a temperature on the order of 140°–200° C., the sulfur/alkylphenol molar ratio ranging from 0.7 to 1.5;
adding at a temperature from 50°–80° C. of an alkaline earth base, an alkylene glycol and an azeotropic solvent selected from the group consisting of (a) the aromatic hydrocarbons, (b) the aliphatic hydrocarbons, and (c) the monoalcohols with a boiling point greater than 120° C., the quantities of reagents corresponding to the following molar ratios:
alkaline earth base/alkylphenol of 0.5 to 2,
alkaline earth base/alkylene glycol of 1.2 to 1.4,
followed by carboxylating the mixture so obtained with a quantity of cabon dioxide at a temperature of 100°–185° C. and under about atmospheric pressure, said quantity of $CO_2$ being in the range between that amount of $CO_2$ which can be completely absorbed by the reaction medium and an excess of 30% of said amount.

7. Additives according to claim 1, 2, 3, 4, or 5, wherein the quantities of reagents used in the third stage correspond to the following molar ratios:
sulfur/alkylphenol ranging from 0.7 to 1.3, and
alkaline earth base/alkylphenol ranging from 0.8 to 1.7.

8. A lubricating composition containing a lubricating oil and from 1–30 weight % of a detergent-dispersant additive made by the process comprising the following stages:

a. In a first stage, neutralizing an alkylphenol, said alkylphenol having one or more $C_8$–$C_{30}$ alkyl substituents, by means of an alkali metal hydroxide, with the formation of water, in the presence of an azeotropic solvent forming an azeotrope with said water, selected from the group consisting of the aromatic or aliphatic hydrocarbons with a boiling point above 70° C., said neutralization being carried out at a temperature at least equal to that of the formation of the azeotrope, the reaction quantities used corresponding to the molar ratio:
alkali metal hydroxide/alkylphenol ranging from 0.1 to 1; and
eliminating the water and any azeotropic solvent to form a first product comprising alkali metal alkylphenate;

b. in a second stage, carboxylating said first product to convert the alkali metal alkylphenate formed in said first product into alkali metal alkylsalicylate by means of carbon dioxide at a temperature of 100° to 185° C. under a pressure from atmospheric pressure to 15 bars for at least 1 hour in the presence of a dilution oil or an aromatic or aliphatic hydrocarbon with a boiling point greater than 70° C., the quantity of $CO_2$ corresponding to that necessary to obtain a maximum conversion of the alkali metal alkylphenate into alkali metal alkylsalicylate, to form a second product;

c. in a third stage, sulfurizing-superalkylinizing said second product by adding elemental sulfur in the presence of an alkaline earth base, an alkylene glycol and an azeotropic solvent, said azeotropic solvent selected from the group consisting of (a) the aromatic hydrocarbons, (b) the aliphatic hydrocarbons, and (c) the monoalcohols with a boiling point greater than 120° C., at a temperature in the range of about 140°-230° C., the quantities of reagents used corresponding to the following molar ratios:

sulfur/alkylphenol ranging from 0.7 to 1.5, alkaline earth base/alkylphenol from 0.5 to 2, alkaline earth base/alkylene glycol ranging from 1.2 to 1.4, and followed by carboxylating said second product with a quantity of carbon dioxide at a temperature of 100°-185° C. and under about atmospheric pressure, said quantity of $CO_2$ being in the range between that amount of $CO_2$ which can be completely absorbed by the reaction medium and an excess of 30% of said amount;

d. eliminating the alkylene glycol and the azeotropic solvent after addition of dilution oil;

e. filtering; and f. collecting a final product.

* * * * *